United States Patent [19]

Eckel

[11] Patent Number: 4,945,606

[45] Date of Patent: Aug. 7, 1990

[54] DOOR CAM HARDWARE WITH DOOR POST MOUNTED CAM

[75] Inventor: Alan Eckel, Westford, Mass.

[73] Assignee: Eckel Industries, Inc., Cambridge, Mass.

[21] Appl. No.: 721,196

[22] Filed: Apr. 9, 1985

Related U.S. Application Data

[63] Continuation-in-part of Ser. No. 468,570, Feb. 22, 1983, abandoned.

[51] Int. Cl.[5] ..... E05F 1/04

[52] U.S. Cl. ..... 16/313; 16/250

[58] Field of Search ..... 16/309–318, 16/250; 49/237–239, 501

[56] References Cited

U.S. PATENT DOCUMENTS

| | | | |
|---|---|---|---|
| 1,608,299 | 11/1926 | Carpenter et al. | 16/315 |
| 2,586,757 | 2/1952 | Wummel et al. | 16/250 |
| 2,661,495 | 12/1953 | Kalleberg | 16/315 |
| 2,718,026 | 9/1955 | Slopa et al. | 76/313 |
| 2,827,117 | 3/1958 | Bateman | 16/315 X |
| 2,840,848 | 7/1958 | Hickey | 16/313 |
| 3,206,792 | 9/1965 | Beck | 16/250 |
| 4,078,334 | 3/1978 | Lambias | 49/237 |
| 4,124,955 | 11/1978 | Kochis | 49/237 |
| 4,406,034 | 9/1983 | Lindemann | 16/284 |

*Primary Examiner*—Frank T. Yost
*Assistant Examiner*—Rinaldi Rada
*Attorney, Agent, or Firm*—Schiller, Pandiscio & Kusmer

[57] ABSTRACT

Improved cam hardware for use with a self-positioning door. The cam is attached to the door mounting post by a threaded connection and has a lower surface which is symmetrically inclined about a high point. The lower surface is contacted by a cam follower roller which is rotatably attached to the door jamb. When the door is opened and released, the cam coacts with the cam follower roller to cause the door to return to its original position where the high point is mated with the roller.

9 Claims, 9 Drawing Sheets

DOOR CAM HARDWARE WITH DOOR POST MOUNTED CAM

This is a continuation-in-part of my copending application Ser. No. 468570 filed Feb. 22, 1983 for Door Cam Hardware now abandoned.

The present invention pertains to improved cam hardware for a door; more specifically, it is related to an arrangement wherein a self-closing door is mounted to a rotatable post onto which is attached an improved inverted cam structure that moves on a roller affixed to the door jamb.

PRIOR ART

Door hardware that utilizes a cam and roller arrangement so as to provide a self-positioning door is well known. Normally, hardware of this type includes a rotatable door post to which the door is mounted. The post usually rotates within, and is supported by, two journal bearings that are affixed to the door jamb—a lower bearing, and an upper bearing that has a curved upper surface and also functions as a cam.

In this typical prior art door hardware configuration, a cam follower device attached to the upper end of the door post has an attached roller member which coacts with the curved upper surface of the cam affixed to the door jamb. When the door is in its normally closed and at-rest position, the roller member rests in a depression in the upper surface of the cam. When the door is opened in either direction, the roller moves up an inclined portion of the curved surface, so that when the door is subsequently released the roller will tend to move back down the inclined surface to the cam's depression, thereby causing the door to return to its normally closed position. Self-closing doors utilizing door hardware of this type are exemplified in U.S. Pat Nos. 4122887, 4124955, and 4292764, and in the references cited therein.

One problem with this type of door cam hardware arrangement is that dirt tends to accumulate on the curved upper surface of the upper bearing. Eventually, enough of this dirt may collect on the upper surface to interfere with proper operation of the roller on the cam surface. Dirt also tends to accumulate in the area of the roller and thus may impede proper operation of the roller.

Another prior art configuration utilizes the same hardware described above together with a compression spring positioned around the door mounting post just below the lower bearing in order to provide a resistance force against the force required to push the door open. A problem with the latter configuration is that the resistance force tends to gradually increase with time, primarily because of accumulation of dirt which causes increased frication between moving parts.

Another configuration of prior art door hardware comprises an inverted crown cam member nonrotatably mounted on the upper end of the door mounting post so as to be capable of sliding axially up and down the post a predetermined distance while being contained at the top of the post. This cam has a substantially flat side surface which is slidably positioned against the door side jamb so as to prevent rotation of the cam member about the door post. A compression spring is positioned above the cam and exerts a downward force on the cam. A roller-type cam follower is nonrotatably and nonslidably affixed to the door post just below the cam member so that the roller travels down the inverted crown cam member's inclined lower surface when the door is opened in either direction. Door hardware of this type is exemplified in U.S. Pat. No. 3,262,365 and in the references cited therein. Door hardware of the type shown in U.S. Pat. No. 3,262,365 suffers from problems similar to the problems of the other types of door hardware previously described.

OBJECTS OF THE PRESENT INVENTION

It is therefore a general object of this invention to provide improved door cam hardware that eliminates, or substantially reduces, the problems noted above. Another object of the invention is to provide improved door cam hardware which is superior to hardware of the type disclosed in U.S. Pat. Nos. 3263365, 4122887, 4124955, and 4292764.

A more specific object is to provide door cam hardware that is quieter in operation than the door hardware of the prior art.

A further object is to provide improved door cam hardware which minimizes problems caused by dirt buildup, yet is reliable and can be produced and installed at less cost.

Still another object of this invention is to provide improved door cam hardware which facilitates the installation of an air seal around the hardware so as to minimize air leakage through the doorway A further object is to provide improved door cam hardware that allows the cam to be precisely positioned at the time of installation.

Finally, it is an object of the invention to provide door cam hard which facilitates leveling the door quickly and easily.

SUMMARY OF THE PRESENT INVENTION

Attainment of these objects is achieved by a new door cam hardware which comprises a cam adapted to be affixed to a door mounting post, a cam follower roller adapted to be attached to a door jamb, and two door post journal bearings which axially align and rotatably support the door mounting post. The cam has a low point and a diametrically opposed high point with those two points being connected by inclined surfaces. The hardware is attached so that when the door is in its normally shut or at-rest position, the cam is disposed so that its high point is engaged with the roller. When the door is opened, the cam rotates with the door mounting post, and simultaneously the cam and door post are forced upwardly as the inclined surface of the cam moves relative to the roller. Since the weight of the door is supported by the cam resting on the roller, the roller acts as a thrust bearing as well as a cam follower. In a selected embodiment the cam and door post are coupled by a threaded connection.

DESCRIPTION OF THE DRAWINGS

For a fuller understanding of the nature and objects of the present invention, reference should be had to the following description taken in connection with the accompanying drawings wherein.

It is to be understood that like numbers refer to like components throughout the drawings.

Figure 1:
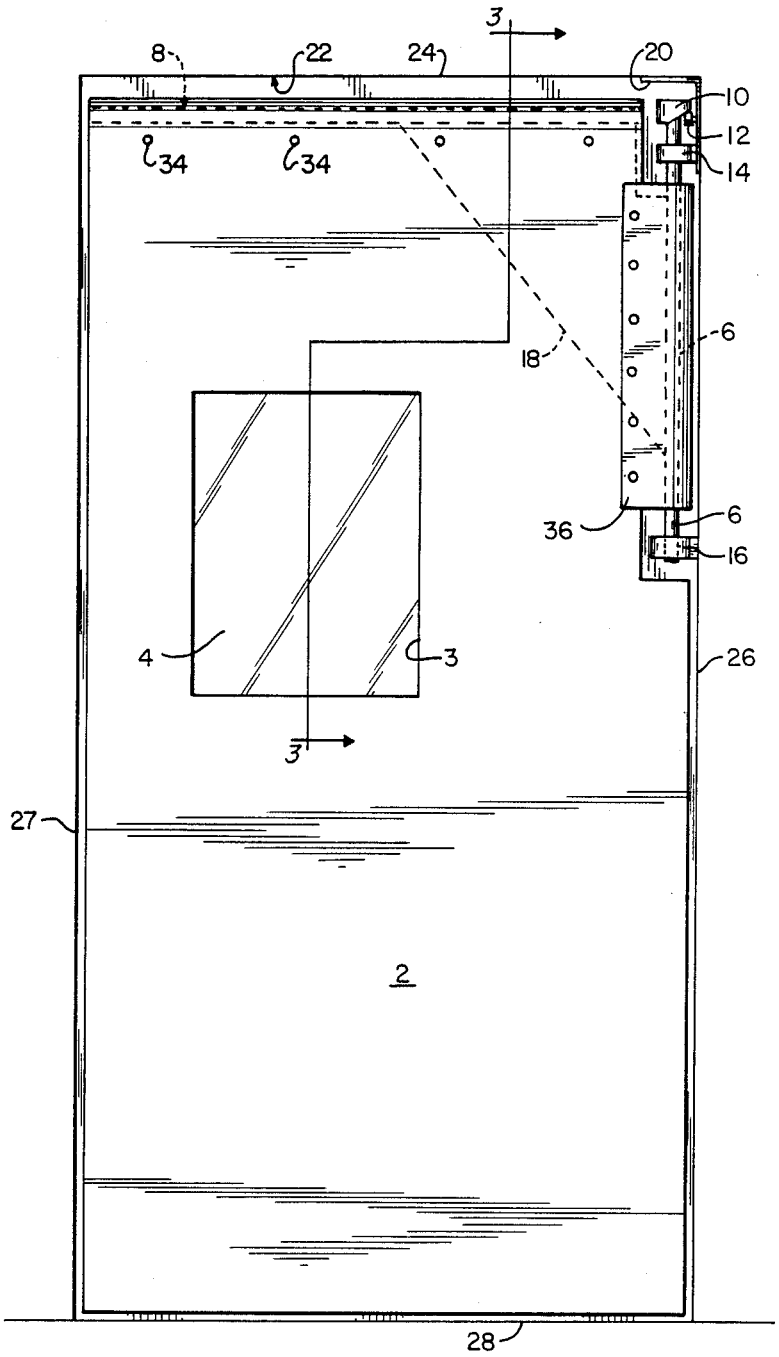
FIG. 1 is a front view in elevation of a door with door cam hardware constructed in accordance with the present invention.

Turning first to FIG. 1, the illustrated apparatus comprises a door panel 2 with a window pane port 3, a window pane 4, a door mounting post 6, a door support yardarm 8, a cam 10, a cam follower roller 12, an upper journal bearing 14, a lower journal bearing 16, a support gusset 18, an angle iron member 20, and various other components described hereinafter. The door fits in a doorway 22 defined by a lintel 24, door jambs 26 and 27, and a floor 28. The weight of panel 2 is supported by mounting post 6, a yardarm 8, and gusset 18.

Figure 2:
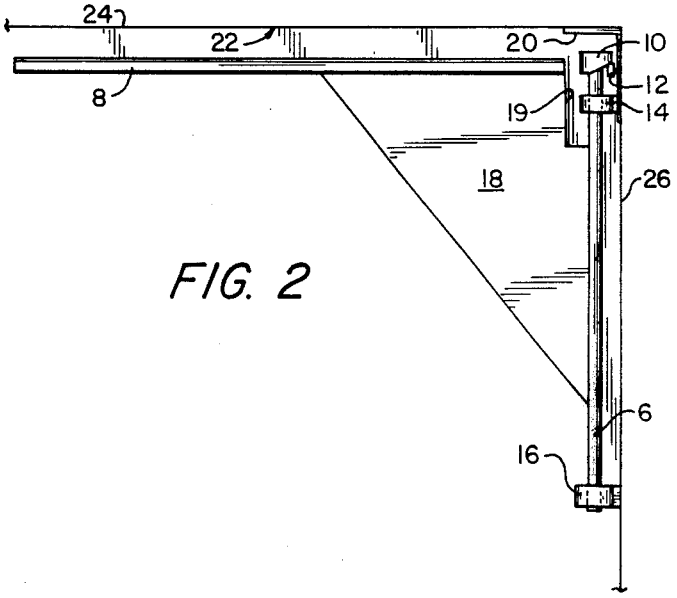
FIG. 2 is a view like FIG. 1 without the door panel.

As seen best in FIG. 2, gusset 18 is secured to yardarm 8 and post 6, preferably by welding, so as to add structural strength to the yardarm 8 which fructions to support door panel 2. Gusset 18 has a generally triangular configuration with one upper corner cut away as shown at 19 (FIG. 2) in order to provide clearance for upper bearing 14 and cam 10. Gusset 18 is made of a suitable material, e.g. from 3/16" steel plate, so that it will provide the support strength required to support a door panel 2.

Figure 3:
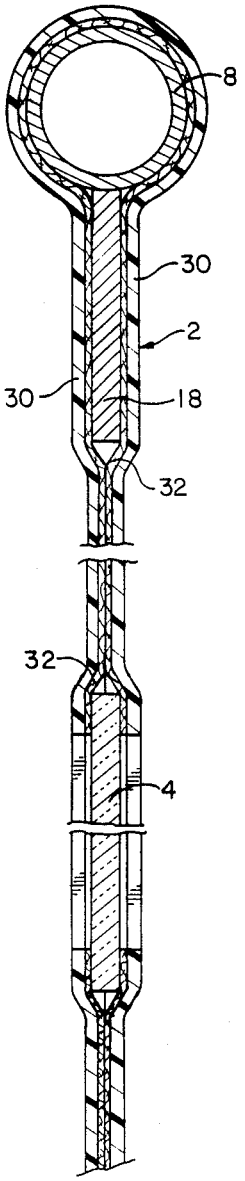
FIG. 3 is a fragmentary cross-sectional view taken along line 3—3 in FIG. 1.

Turning now to FIG. 3, the panel 2 shown in FIG. 1 comprises a two-layer sheet which has been folded over yardarm 8 so that panel 2 has four-ply thickness. The outer layer 30 is made of a resilient material such as plastic, and inner layer 32 is a woven fabric Layer 32 is bonded to layer 30, e.g., with an adhesive When this two-layered sheet has been folded back on itself, the two facing inner fabric layers 32 are bonded to each other, except in certain areas where separation is provided to accommodate window pane 4, yardarm 8, and gusset 18. The folds of panel 2 may also be held together by other means, such as rivets 34, as shown in FIG. 1.

Figure 4:
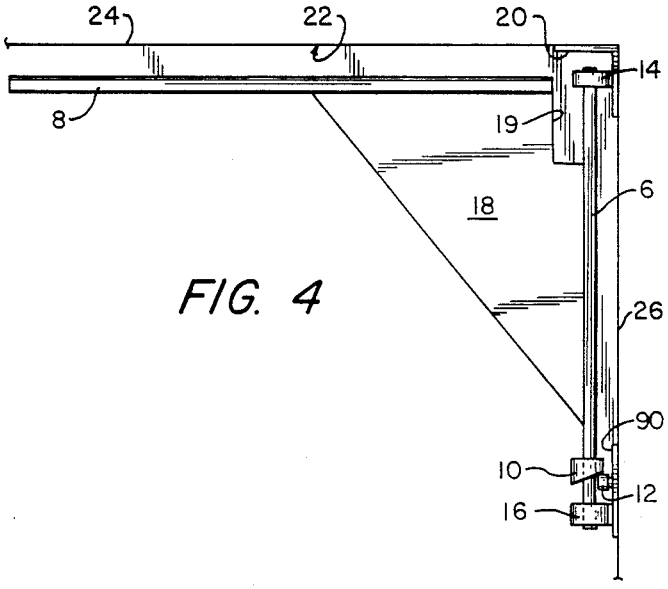
FIG. 4 is a view similar to FIG. 2 of a modification of the invention.

FIG. 4 depicts the same door hardware shown in FIG. 2, with the exception that the cam 10 is mounted on the lower end of post 6 rather than the upper end. The door operates equally well with cam 10 mounted on either end of post 6.

Figure 5:
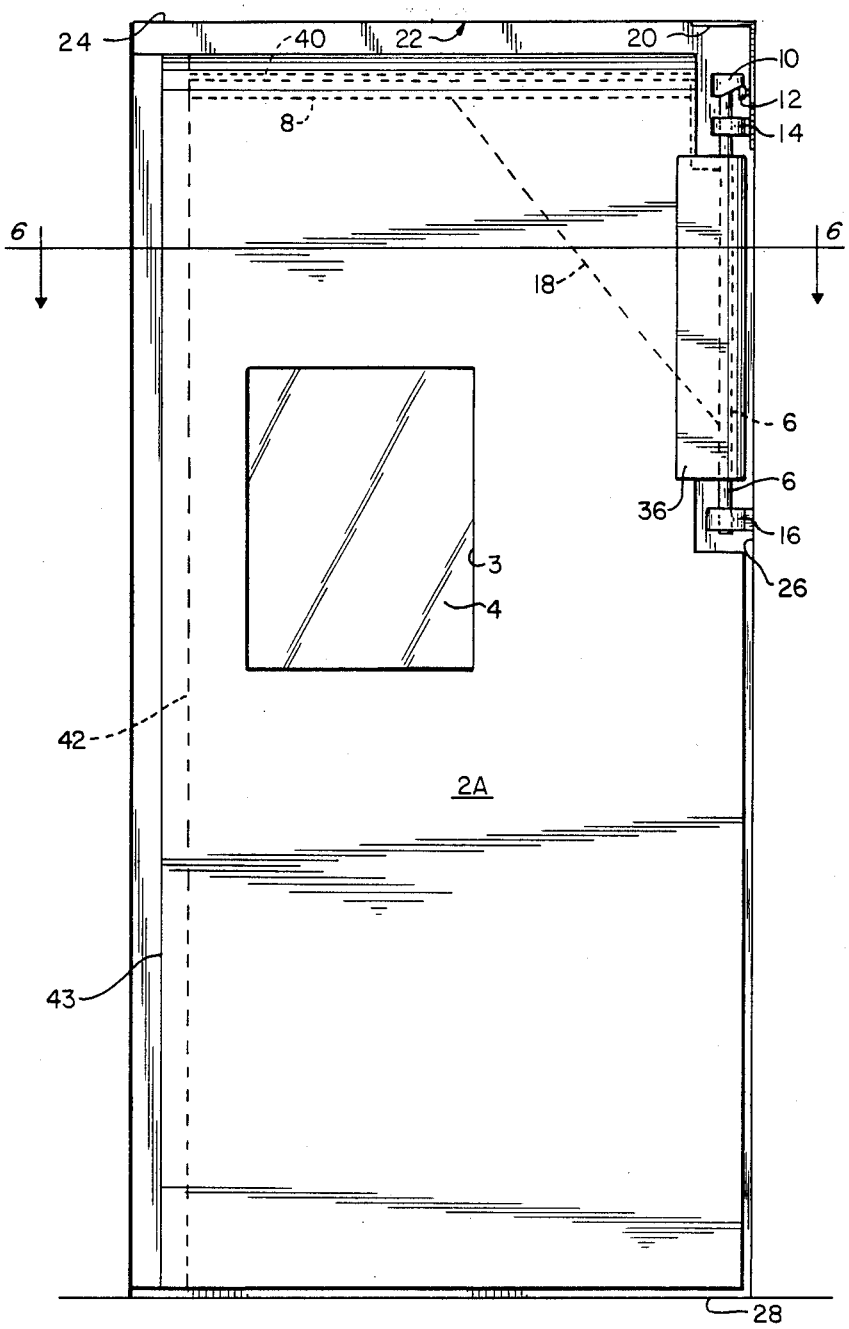
FIG. 5 is a view like FIG. 1 of the invention in combination with a rigid door.
Figure 6:
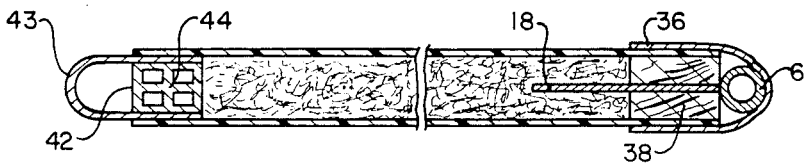
FIG. 6 is an enlarged cross-sectional view taken along line 6—6 in FIG. 5.

Turning now to FIGS. 5 and 6, a rigid door panel 2A is illustrated which is similar in construction to the door shown in FIG. 1 of U.S. Pat. No. 3,979,872. The door hardware shown in FIGS. 5 and 6 is the same as the hardware of FIG. 1. Panel 2A is attached to post 6 by a split sleeve 36 which encloses a wooden stile 38 in addition to post 6. Box-shaped support members 40 and 42 border the top and outer side edges respectively of panel 2A, as shown in FIG. 5. A door nose 43 is affixed to the outside edge of the door adjacent support member 42. FIG. 6 illustrates how an X-shaped stiffening member 44 is integrally attached to the interior of member 42 so as to increase its strength. If desired, the wooden stile 38 may be adapted (e.g., by sawing a suitable kerf) to accommodate a support gusset 18, as shown in FIG. 6. The remainder of the door is similar to the door in FIG. 1 of U.S. Pat. No. 3,979,872, and reference should be made to that patent for further details of the door construction.

Figure 7:
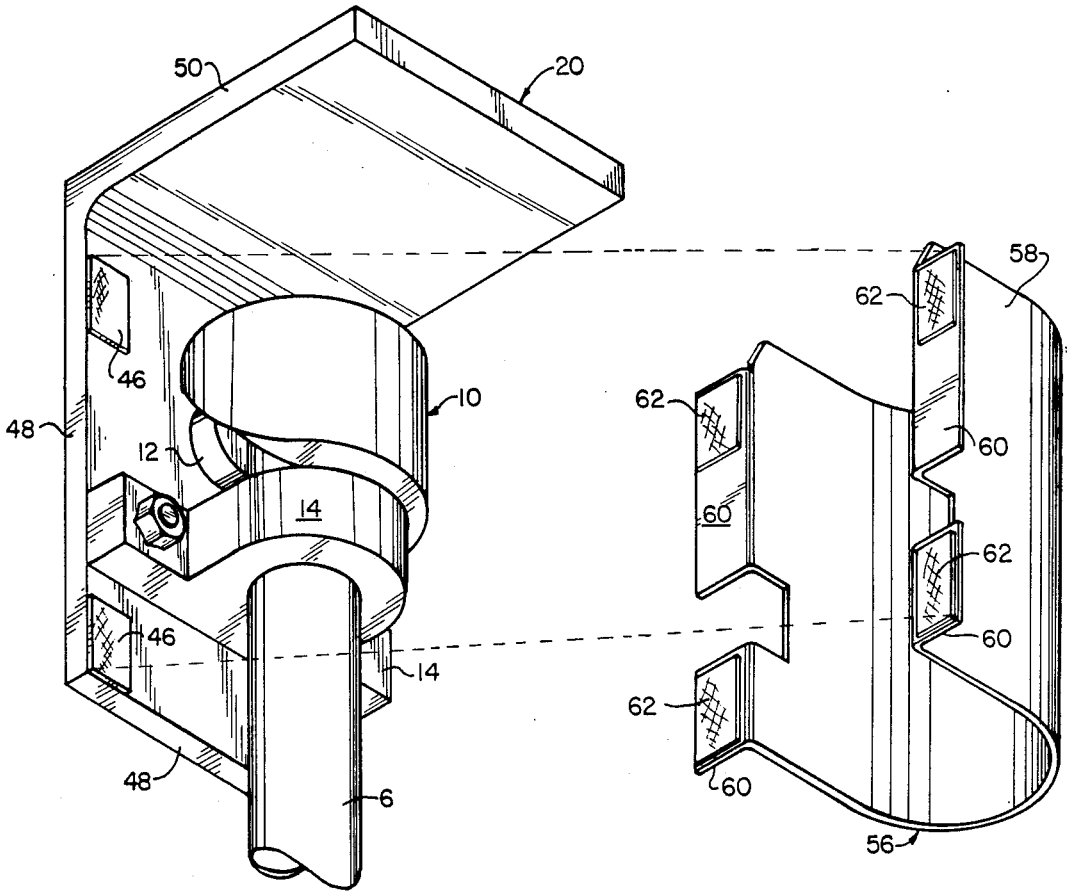
FIG. 7 is an exploded perspective view of an angle iron member and a removable air seal.

Turning now to FIG. 7, an air seal 56 is illustrated that is somewhat similar to the air seal disclosed in U.S. Pat. No. 4,078,334. Air seal 56 minimizes airflow through doorway 22 in the vicinity of the door cam hardware. Four fastening pads 46 are shown affixed to angle iron member 20, which has an L-shaped configuration so as to make a snug fit in the corner formed by the intersection of lintel 24 and door jamb 26. Member 20 comprises a vertical portion 48 affixed to the door jamb 26 by two carriage bolts 52 (FIG. 11), and a horizontal portion 50 similarly attached to lintel 24 by fasteners 54 (FIG. 11).

As seen in FIG. 7, air seal 56 comprises a U-shaped rigid member 58 which has flared portions 60 adapted to accommodate four fastening strips 62. Strips 62 are positioned so as to mate with pads 46 when air seal 56 is affixed to angle iron member 20. Fastening pads 46 and fastening strips 62 are preferably made of a hook-and-loop type material such as VELCRO, a nylon fastening material manufactured by Velcro Corporation of New York, N.Y. This enables air seal 56 to be removably attached to member 20 by simply pressing strips 62 against fastening pads 46. Air seal 56 and flared portions 60 are preferably made with a lightweight metal such as aluminum, but may be made of any suitable rigid or semi-rigid material, e.g. a plastic such as polyvinyl chloride. Air seal 56 is sized so as to envelope the upper journal bearing 14, as well as cam 10 and roller 12 when they are positioned at the upper end of mounting post 6, when seal 56 is attached to member 20.

Figure 8:
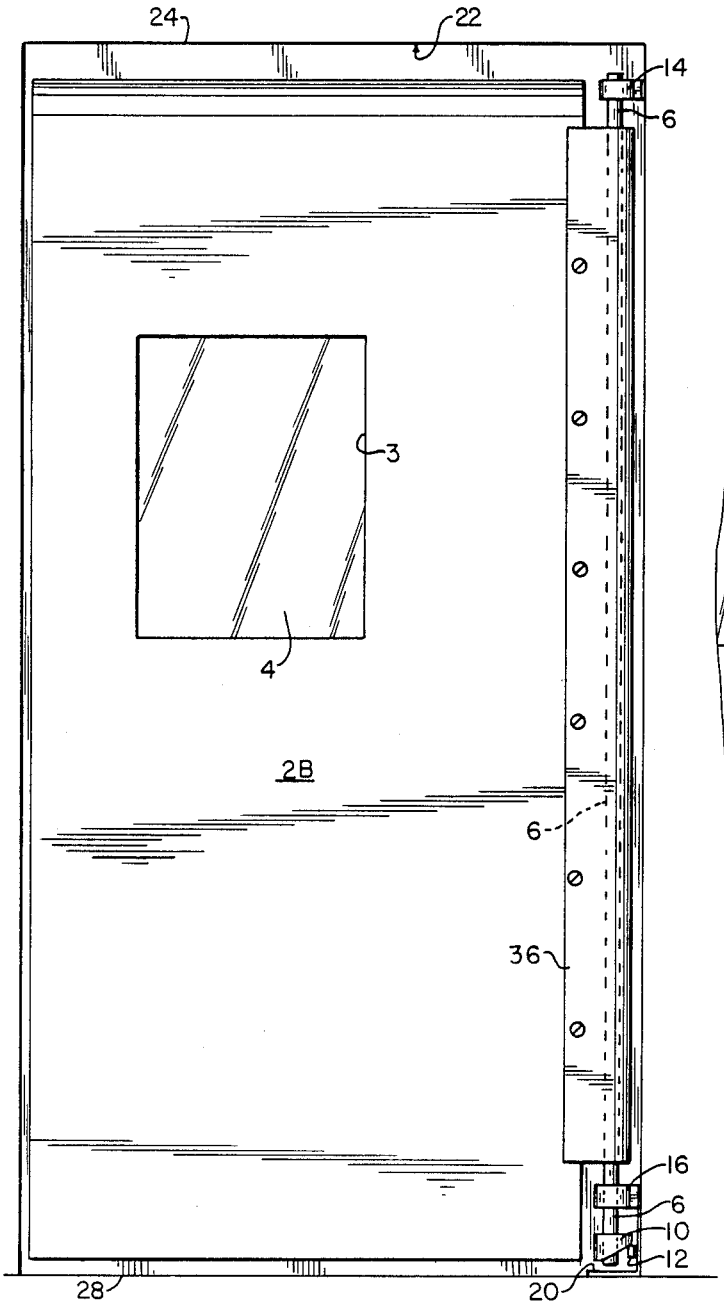
FIG. 8 is a front view in elevation of a modified rigid door with the cam disposed at the bottom end of the door post.
Figure 9:
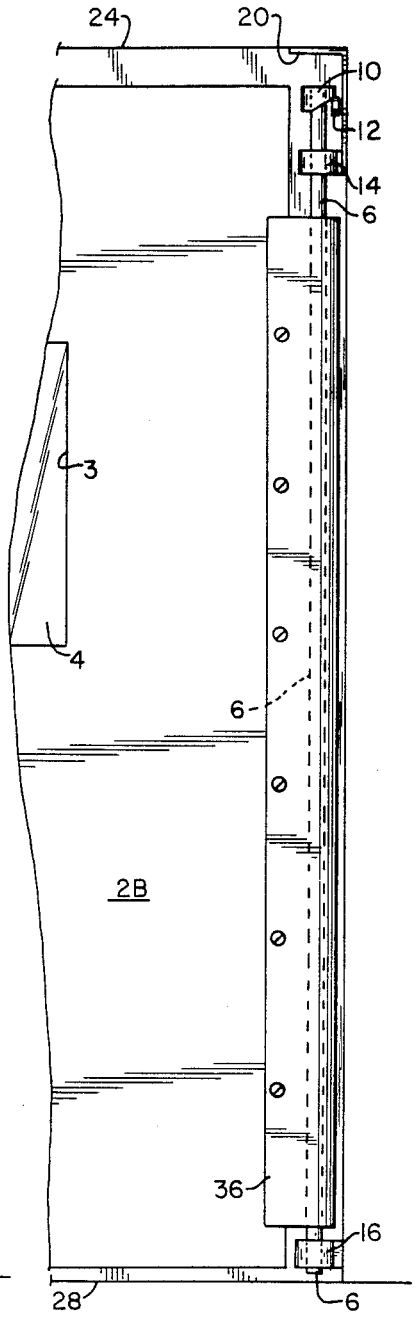
FIG. 9 is a fragmentary front view of a door as shown in FIG. 8, with the cam positioned at the upper end of the door mounting post.

Turning now to FIGS. 8 and 9, a modified version of a rigid door is illustrated having a panel 2B, which is rotatably attached to mounting post 6 by a split sleeve 36A which is affixed to the side of panel 2B along substantially the full height of the door panel. The panel 2B and its attachment means are well-known in the prior art and are displayed in conjunction with the cam hardware of the present invention in FIGS. 8 and 9. FIG. 8 depicts the cam 10 positioned at the upper end of mounting post 6, while FIG. 9 shows cam 10 located on the lower end of post 6.

Figure 10:
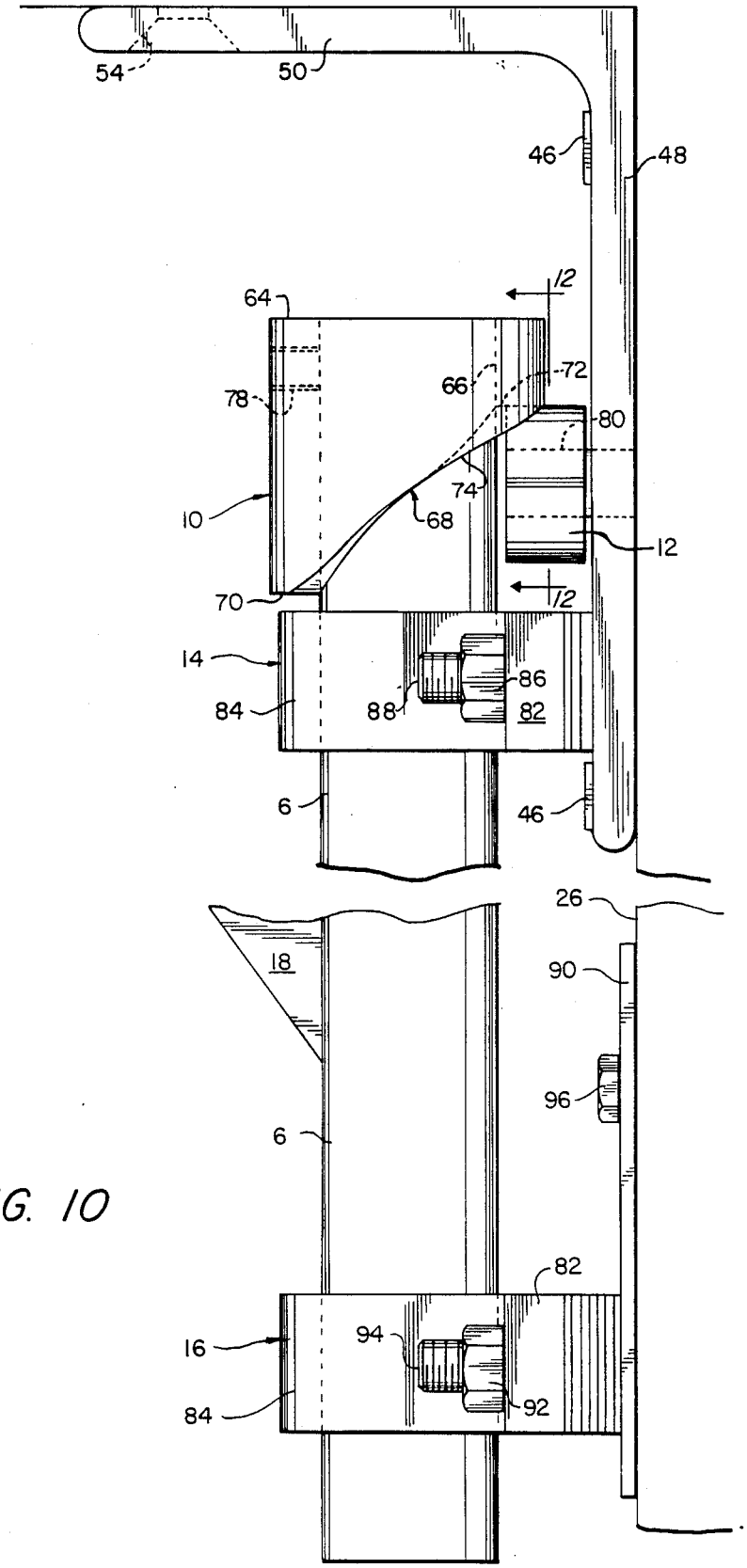
FIG. 10 is an enlarged fragmentary side view in elevation of door cam hardware constituting another form of the present invention.
Figure 11:
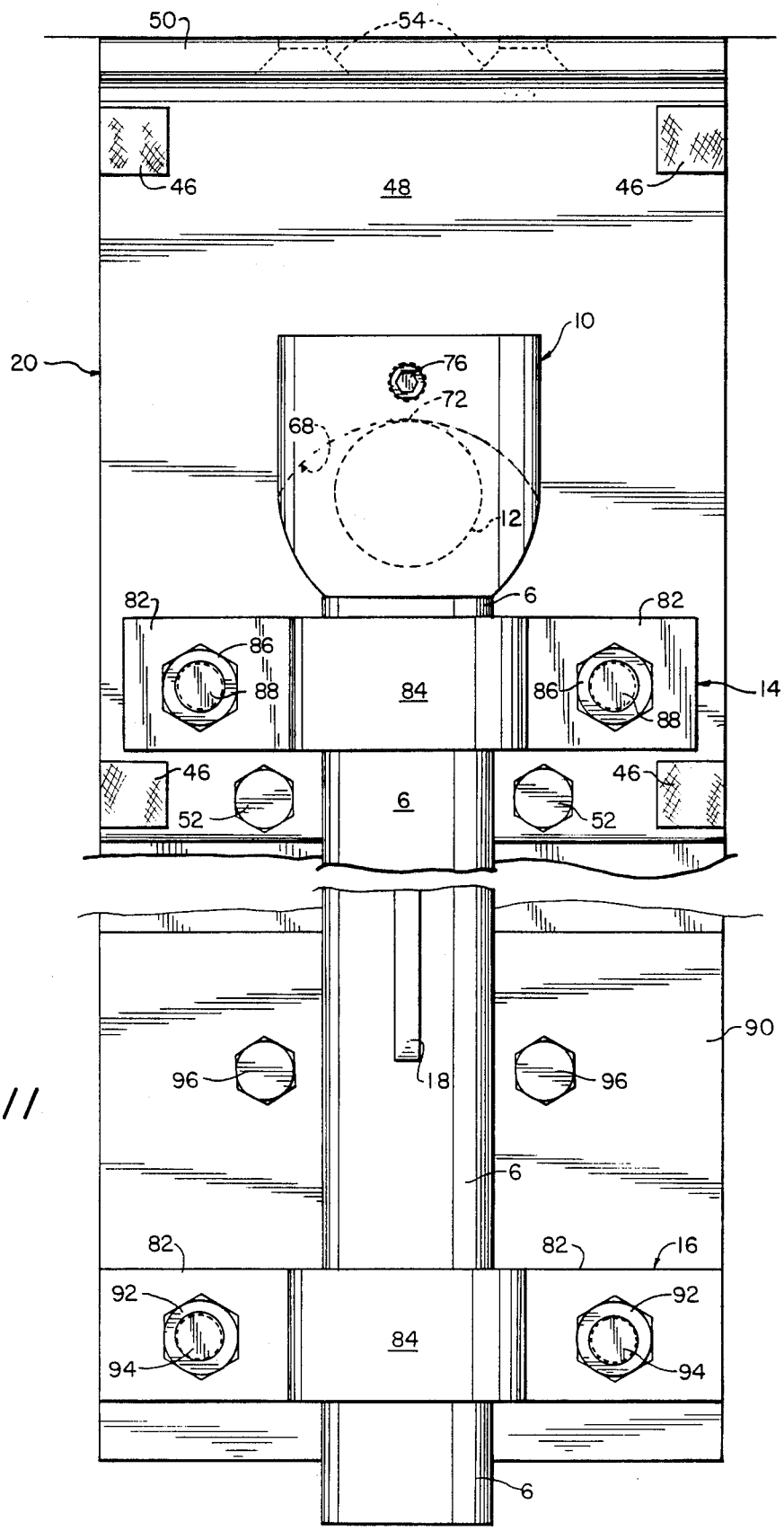
FIG. 11 is an enlarged fragmentary front view of the same hardware shown in FIG. 10.
Figure 12:
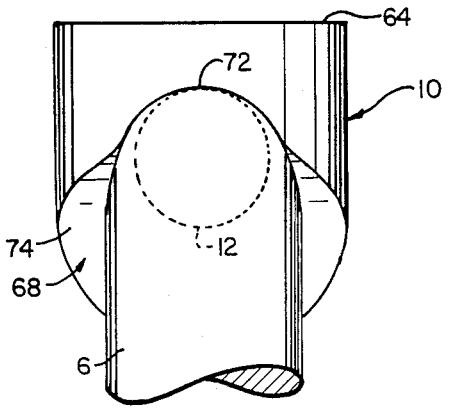
FIG. 12 is an enlarged view taken along line 12—12 in FIG. 10, with the cam follower roller shown in phantom.

Turning now to FIGS. 10–12, the cam 10 has a generally hollow cylindrical configuration and has a substantially planar upper end 64 with an axial through bore 66 which is normal to end 64. The lower end of cam 10 comprises a curved end surface 68 surrounding bore 66. Surface 68 has a low portion 70 and a high point portion 72. The radial position of low portion 79 is 180 degrees diametrically opposite high point portion 72. Arcuately inclined sections 74 of surface 68 connect portions 70 and 72, and sections 74 are adapted to make a rolling contact with cam follower roller 12.

Referring to FIG. 12, the radius of curvature of the inclined surface sections 74 is substantially the same as that of roller 12, so that the high portion 72 of surface 68 snugly accommodates roller 12 when cam 10 is in its normal at-rest position shown in FIGS. 1, 10 and 11. The vertical bore 66 through the center of cam 10 is sized to make a sliding and rotatable fit with the door mounting post 6. As seen in FIGS. 10 and 11, cam 10 is secured to post 6 by a set screw 76 positioned in a threaded hole 78 through the side of cam 10.

As best seen in FIG. 10, cam follower roller 12 is rotatably mounted on a cylindrical shaft 80 which is permanently attached, e.g. by welding, to vertical portion 48 of angle iron member 20. The upper surface of roller 12 makes continuous contact with the curved edge surface 68 of cam 10. Cam 10 rides on roller 12, and roller 12 simultaneously rotates on shaft 80 so as to result in a rolling contact between roller 12 and cam 10. In addition to functioning as a cam follower relative to cam 10, roller 12 also supports the weight of door panel 2 and thereby acts as a thrust bearing for the door (see both FIGS. 1 and 8).

As shown in FIGS. 1, 2, 10, and 11, bearings 14 and 16 each have a flat plate portion 82 and a lug-like portion 84 which projects from plate portion 82. Upper bearing 14 is preferably positioned below cam 10 and roller 12, and is attached to vertical portion 48 of member 20 by fasteners such as nuts 86 and bolts 88. Lower bearing 16 is similarly attached to a mounting plate 90 by two nuts 92 threaded onto bolts 94. Bolts 88 and 94 are integrally attached to member 20 and plate 90, respectively. Member 20 and plate 90, in turn, are attached to door jamb 26 by carriage bolts 52 and 96, respectively. Bearings 14 and 16 have vertical bores 98, through their projecting portions 84, which make a rotatable fit with door mounting post 6.

Operation of the door cam hardware of the present invention is described in connection with the embodiment illustrated in FIG. 1 in the situation where a fork-lift truck or other vehicle is passing through the doorway 22. When the fork-lift truck (not shown) strikes door panel 2, the lower portion of panel 2 tends to pivot on the axis of post 6. As a result, the motion of the lower portion of panel 2 is transmitted with some time delay to the upper portion of panel 2 and the yardarm 8, causing the door to open in a very easy manner.

When the truck has passed through the doorway 22 far enough to be free of door panel 2, the self-positioning feature of the door cam hardware causes the door panel 2 to return to its normal at-rest and closed position.

Cam 10 stops rotating and door panel 2 comes to rest in its normally closed position when roller 12 is mated with high point 72 of surface 68 of cam 10. The at-rest reference position of panel 2 may be adjusted by loosening set screw 76 and rotating cam 10 on post 6 by a selected amount.

Figure 13:
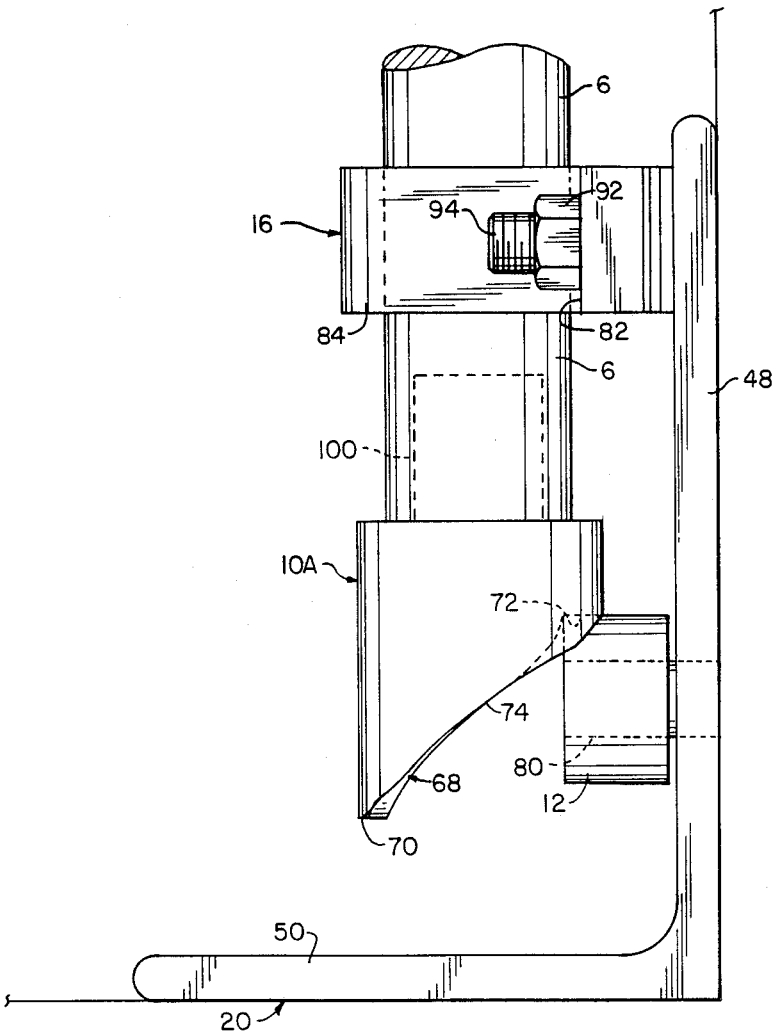
FIG. 13 is an enlarged fragmentary side view illustrating a modified cam and mounting post arrangement.

A possible modification of the door cam hardware of the present invention is illustrated in FIG. 13. In this case, cam 10A is attached to the lower end of post 6 as, for example, by screwing a threaded male component 100 into a correspondingly threaded female blind bore in post 6. This modification permits the cam to have a smaller diameter as shown. A smaller cam 10A allows for more lightweight door hardware, as well as allowing for a smaller air seal 56 to minimize airflow through doorway 22.

Figure 14:
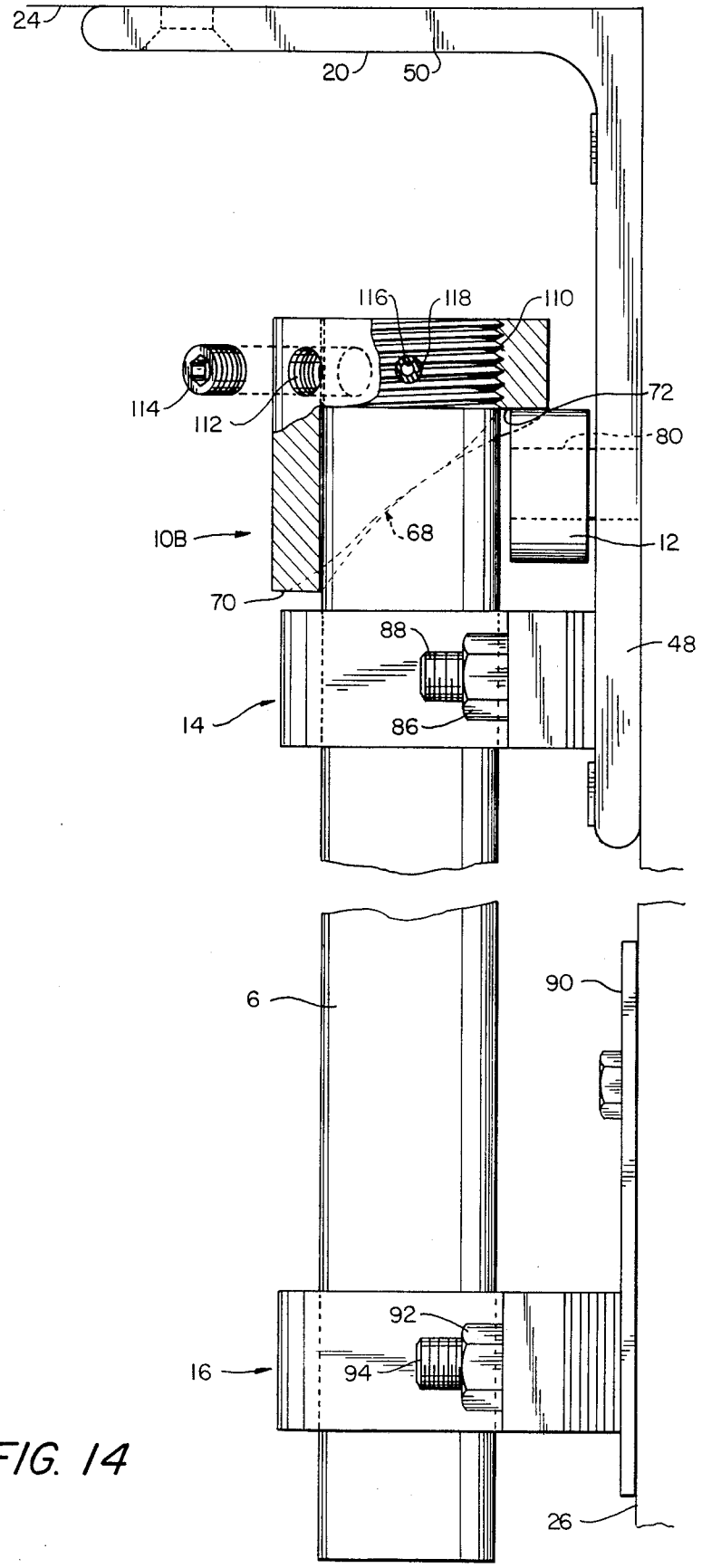
FIG. 14 is a view similar to FIG. 10 showing a preferred embodiment of the invention.

FIG. 14 shows a preferred embodiment of the invention that facilitates adjustment of the position of the cam at the time the door and mounting hardware are installed in a door opening, so as to assure that the door will be in a dead center position. The embodiment of FIG. 14 is similar to the embodiment of FIG. 10. In this embodiment the upper end of the door-mounting post 6 is externally threaded as shown at 110. The cam 10B is made with a tapped radially-extending hole 112 to receive a set screw 114, and a second hole 116 that extends fully across a diameter of the cam. Additionally cam 10B is internally threaded so as to mate with the threads 110 on the door-mounting post. Cam 10B may be screwed onto post 6 at the factory or at the installation site. In fact while shaft 80 of roller 12 is permanently secured to angle iron 20 at the factory, cam 10B and bearing 14 may be attached to post 6 and angle iron 20 either at the factory or at the time of installation.

At the time the door panel is mounted to a door frame via the mounting post 6, set screw 114 may be loosened and the cam 10B then rotated relative to post 6 by the installer so that roller 12 and the high point portion 72 of surface 68 of the cam cooperate to locate and hold the door in dead center position. The term "dead center position" is used to designate when the plane of door panel 2 is coplanar with lintel 24 and door jambs 26 and 27. Then the set screw 114 is tightened to lock the cam to the door post. Thereafter hole 116 is used as a guide to drill a hole diametrically through the door post, and then a roll pin 118 is inserted in hole 116 and the formed hole in post 6 so as to permanently lock the cam to the door post. Preferably the hole 116 is drilled in the cam at the factory, but it may be drilled at the time of installation. In either case, the hole 116 drilled in the cam facilitates subsequent drilling of a matching hole in the door post to receive the roll pin 118.

With respect to the embodiment of FIG. 14, The ability to adjust the position of the cam at the time of installation, and thereafter to permanently lock the cam in its selected locking position, is significantly advantageous where two swinging doors are mounted in the door frame, since the cam adjustment feature facilitates mounting the two doors so that their noses are in coplanar and edge-to-edge relation when the doors are at rest.

There are several advantages of the present invention over the prior known forms of door cam hardware. First of all, the overall noise level associated with the operation of the door cam hardware of this invention is substantially less than that associated with the prior art hardware. Also the inclined sections 74 of surface 68 are symmetrically configured on either side of high point 72 so as to minimize oscillations of point 72 past roller 12 when the door is closing. Also, prior art hardware generally allows the inertia of the door to cause much more oscillating motion through the at-rest position while the door is closing.

Since roller 12 makes contact with the underside of cam 10 (rather than with the upper surface, as with most prior door cam hardware), the building up of dirt on the contact surface is kept to a minimum, and hence the desired operation is less likely to be impeded by accumulating dirt. Minimization of dirt accumulation is effected by utilizing an air seal 56. Such minimization results in free movement of cam 10 on roller 12 over a longer period of time; thus, the period of time between door repairs is increased, and the operational life of the door is effectively increased.

Another advantage of the present invention is that the overall cost of producing the hardware is less than the cost of most similar prior art hardware. One reason for this lower cost is that cam 10 may be made somewhat smaller than most similar prior art cams. This smaller cam size also allows the use of a smaller air seal 56 for minimizing airflow through doorway 22.

Most importantly, the door cam hardware of this invention facilitates installation of the door and hardware in a doorway 22. Door cam hardware of the prior art, e.g., as represented by U.S. Pat. Nos. 4078334 and 4292764, normally requires that someone hold the door panel 2 in its desired position in the doorway 22 while the cam and lower bearing are attached to the door jamb. If the doorway is not square or the door is not hung square, adjustments are complicated because the door must be supported while the adjustments are being made In contrast, the present invention facilitates installation and dead center position 12 of the door panels.

With the preferred embodiment, the installation procedure involves: (1) mounting angle iron member 20, which has roller 12 and shaft 80 attached, in the doorway corner formed by the lintel 24 and door jamb 26; (2) mounting the post 6, with door panel 2 and cam 10B attached so that the cam contacts roller 12; (3) affixing upper journal bearing 14 to bolts 88 by nuts 86; and (4) placing lower journal bearing 16 on the lower end of post 6 and affixing it to mounting plate 90 by stud bolts 94 and nuts 92, and then adjusting the position of the cam on post 6. The angle iron member 20 can be easily adjusted as necessary to properly align the door panel 2 with doorway 22. For example, if the top of panel 2 is not parallel to the horizontal lintel 24, proper alignment may be attained either by positioning shims between lintel 24 and horizontal portion 50 of member 20, or by positioning an appropriate number of shims between door jamb 26 and vertical portion 48 of member 20. Still other advantages will be obvious to persons skilled in the art.

What is claimed is:

1. Improved door-supporting and door self-positioning hardware comprising in combination:

a door-mounting post;

means for mounting a door to said post so that said door and post will rotate as a unit;

attaching means for rotatably attaching said post to a door jamb in a predetermined door opening, said attaching means comprising an angle iron adapted to be secured to a corner of a door jamb and a first journal bearing for rotatably mounting said post to said angle iron, said angle iron comprising first and second portions arranged at a right angle to one another, and said first journal bearing having a first hollow portion surrounding and rotatably engaging one end of said post and a second plate portion that is attached to said first portion of said angle iron; and a cam follower roller unit comprising a shaft attached to said first angle iron portion at a right angle thereto and a cam follower roller rotatably mounted to said shaft;

a cam attached to one end of said post so as to rotate therewith, said cam having an inclined surface with low and high points disposed in substantially diametrically opposed relation to one another;

said cam and cam follower roller being positioned so that said cam follower roller makes a rolling contact with said inclined surface of said cam as said cam rotates with said door-mounting post and a door attached to said post; and a second journal bearing rotatably engaging the opposite end of said post for rotatably mounting said door-mounting post to a door jamb.

2. Apparatus as defined by claim 1 wherein said means for mounting a door to said post comprises a gusset plate adapted to be attached to said door, said gusset plate being attached to said post so as to rotate therewith.

3. Apparatus as defined by claim 1 wherein said means for mounting a door to said post comprises a gusset plate attached to said post and a yardarm attached to said gusset plate.

4. Apparatus according to claim 1 wherein said plate portion of said first journal bearing comprises a plurality of holes, and further including threaded fastening members affixed to said first portion of said angle iron and projecting through said holes, and nuts screwed onto said threaded members so as to releasably clamp said plate portion of said first journal bearing to said first portion of said angle iron.

5. Apparatus according to claim 1 wherein said cam is screwed onto said post, and further including means for locking said cam to said post.

6. Apparatus according to claim 1 further including air seal means for minimizing air flow through said door opening in the vicinity of said cam, said air seal means comprising:

a U-shaped cover member having (a) a body portion shaped so as to envelope said cam and said first journal bearing and (b) first and second co-planar sections that extend parallel to the plane of said door jamb; and means for releasably attaching said first and second co-planar sections of said cover member to said first portion of said angle iron.

7. Apparatus according to claim 1 wherein said cam has an axially-extending bore that is threaded, and said one end of said post is externally threaded, and further wherein said cam is screwed onto said post, and further including means connecting said cam and said post for locking said cam against rotation relative to said post.

8. Improved door apparatus comprising in combination:

a door-mounting post;

a gusset plate attached to said post so as to rotate therewith;

a yardarm attached to said gusset;

a resilient door supported by said yardarm and gusset plate, said gusset plate being disposed within said resilient door and secured thereto;

attaching means for rotatably attaching said post to a door jamb, said attaching means comprising an angle iron adapted to be secured to a corner of a door jamb and a first journal bearing for rotatably mounting said post to said angle iron, said angle iron comprising first and second portions arranged at a right angle to one another, and said first journal bearing having a first hollow portion surrounding and rotatably engaging one end of said post and a second plate portion that is releasably attached to said first portion of said angle iron, and a cam follower roller unit comprising a shaft attached to said first angle iron portion so as to project therefrom at a right angle thereto and a cam follower roller rotatably mounted to said shaft;

a cam screwed onto said post so as to rotate therewith, said cam having an inclined surface with low and high points disposed in substantially diametrically opposed relation to one another; and means releasably locking said cam to said post so that said cam and post will rotate as a unit;

said cam and cam follower roller being positioned so that said cam follower roller makes a rolling contact with said inclined surface of said cam as said cam rotates with said door-mounting post and said door.

9. Improved door apparatus comprising in combination:

a door-mounting post;

means for mounting a door to said post so that said door and post will rotate as a unit;

a mounting plate adapted to be secured to a corner of a door opening, said mounting plate having a flat portion that extends parallel to said post;

a first journal bearing for rotatably mounting said post to said mounting plate, said first journal bearing comprising a first hollow portion that surrounds and rotatably engages one end of said post and a second plate portion that lies flat against said flat portion of said mounting plate, said second plate portion having at least one hole;

fastener means for releasably attaching said second plate portion of said first journal bearing to said mounting plate, said fastener means comprising at least one threaded member attached to said flat portion of said mounting plate and extending through said at least one hole, and at least one nut screwed onto said at least one threaded member and forcing said second plate portion tight against said flat portion of said mounting plate; a cam follower roller unit comprising a shaft affixed to and extending at a right angle to said mounting plate and a cam follower roller rotatably attached to said shaft;

a cam mounted on said post, said cam having an inclined surface with high and low points disposed in substantially diametrically opposed relation to one another;

a threaded connection between said cam and said post;

means for locking said cam to said post so that said cam and post will rotate as a unit; and a second journal bearing rotatably engaging the opposite end of said post and rotatably mounting said door post to a door jamb;

said cam and cam follower roller being positioned so that said cam follower roller makes a rolling contact with said inclined surface of said cam as said cam rotates with said door-mounting post and said door.

* * * * *